US006602106B2

(12) United States Patent
Cheung

(10) Patent No.: US 6,602,106 B2
(45) Date of Patent: Aug. 5, 2003

(54) WALKING DEVICE

(76) Inventor: Lik Yuen Cheung, 4/F, No. 17, Wah Yuen Building, 17-21 Tong Chong Street, Quarry Bay, Eastern District (HK)

( * ) Notice: Subject to any disclaimer, the term of this patent is extended or adjusted under 35 U.S.C. 154(b) by 0 days.

(21) Appl. No.: 10/144,151

(22) Filed: May 9, 2002

(65) Prior Publication Data

US 2003/0017780 A1 Jan. 23, 2003

(30) Foreign Application Priority Data

Jul. 20, 2001 (CN) ..... 01231118 U

(51) Int. Cl.[7] ..... A63H 11/00
(52) U.S. Cl. ..... 446/330; 446/355; 446/377
(58) Field of Search ..... 446/330, 353, 446/354, 355–356, 293, 294, 376, 377, 352

(56) References Cited

U.S. PATENT DOCUMENTS 3,267,608 A * 8/1966 Ryan
3,484,988 A * 12/1969 Robbins
3,940,879 A * 3/1976 Glass et al. ..... 46/102
4,795,395 A * 1/1989 Oishi et al. ..... 446/175
4,944,708 A * 7/1990 Kawabe ..... 446/175
5,224,896 A * 7/1993 Terzian ..... 446/355
5,628,668 A * 5/1997 Takemae ..... 446/355
6,146,235 A 11/2000 Migliorati ..... 446/355

FOREIGN PATENT DOCUMENTS

WO 00/07680 2/2000
WO 01/17631 3/2001

* cited by examiner

*Primary Examiner*—Jacob K. Ackun
*Assistant Examiner*—Jamila Williams
(74) *Attorney, Agent, or Firm*—Ostrolenk, Faber, Gerb & Soffen, LLP

(57) ABSTRACT

A walking device (10) comprising a body portion (11), defining a front, a rear and sides extending between the front and rear. A pair of legs (12) are disposed on each side of the body portion (11) and are connected at an upper end thereto and define a heel (18) at the other end. A foot (13) is disposed at the lower end of each leg (12). The legs (18) are connected to the body portion (11), by a pair of spaced-apart shafts (15, 16) and each shaft includes an eccentric end portion (15*b*, 16*b*), which is received in an opening formed in each respective leg (12). One of the openings (21) is a journal opening which confines the end portion (16*b*) to rotation relative to the leg (12), while the second opening (23) is formed as a slot and permits the end portion (15*b*) rotational and lengthwise movement within the opening (23) relative to the leg (12). Rotation of the pair of shafts (15, 16) causes the legs (12) to move in a walking motion, in generally opposite directions.

20 Claims, 9 Drawing Sheets

WALKING DEVICE

The present invention relates to a walking device, in particular a toy device, which has a human shape or form and which can walk or traverse across a supporting surface.

Walking toy devices having a human shape or form have been proposed previously. However, such devices known to the applicant have been deficient in requiring large sole plates fitted to the free ends of the legs to support the toy, typically a doll, from toppling over. Such prior art toys also typically have employed unidirectional ratchet wheel bearings on the side of the sole plates which rest on a supporting surface, to facilitate forward movement of the toy. That is, the ratchet wheel bearings rotate in one direction only, generally the forward direction, and resist rotation in the other generally rearward direction. In such arrangements, the walking stride produced is often stiff and therefore of little real similarity to a human stride, while the direction of available movement is forward only.

Other prior art toys employ crank and rocker mechanisms such as is illustrated in FIG. 1. These toys also generally employ large sole plates fixed to the ends of the rocker bars, along with inwardly extending horizontal members which assist to ensure that the toy does not topple over laterally to the direction of movement, when one of rocker bars is lifted to leave only a single sole plate supporting the toy. As will be readily appreciated, these mechanisms also provide for non human-like leg movement, which instead is more robotic-like.

The above types of toy constructions are similar in that each employs rocker bars or connecting rods which also serve as legs, rather than employing actual separate leg members.

Other prior art mechanisms are described in several prior art patent specifications. For example, U.S. Pat. No. 6,146,235 discloses a mechanism for moving the legs of a doll to simulate a walking motion. In this specification, leg supporting elements are rotated on eccentric pins to provide up and down leg movement, while forward and rearward movement is achieved by front and rear fulcrums against which the supporting elements abut during leg movement.

WO 00/07680 also discloses a mechanism for leg movement, in which the legs of the toy or device include jointed knees and the mechanism is such as to facilitate heel strike (against the ground or supporting surface) prior to toe strike. WO 01/17631 likewise discloses a further mechanism for simulated leg movement.

It is the view of the applicant that to date, none of the prior art adequately simulates or mimics proper human leg movement, including foot movement. Accordingly, it is an object of the invention to provide a walking device which more accurately mimics human walking movement at least in respect of foot movement.

It is a further object of the invention to provide a walking device which has a human-like form and which is relatively stable against toppling during walking and which is not restricted to walking movement in a forward direction only.

It is still a further object of the invention to provide a walking device in which the device firmly engages or contacts the surface on which it is mounted to promote walking motion over the surface.

According to the present invention there is provided a walking device comprising i. a body portion, defining a front, a rear and sides extending therebetween;

ii. a pair of legs, one leg being disposed on each side of said body and connected at an upper end to said body and defining a heel at the opposite and lower end for engagement with a supporting surface;

iii. a foot disposed at said lower end of said leg;

iv. a pair of spaced-apart shafts extending through the sides of said body for aid connection of said legs to said body, wherein each shaft includes an eccentric end portion at each end thereof in connection respectively with said legs, each said end portion being received within an opening formed in said leg, a first of the openings being a journal opening which confines said end portion to rotation relative to said leg, and a second of the openings being formed as a slot and permitting said end portion rotational and lengthwise movement within said slot relative to said leg, whereby rotation of each said shaft causes said legs to move in a walking motion, in generally opposite directions.

The invention will now be described with reference to the following examples. It is understood that the examples are provided by way of illustration of the invention and that they are in now way limiting to the scope of the invention.

Figure 1:
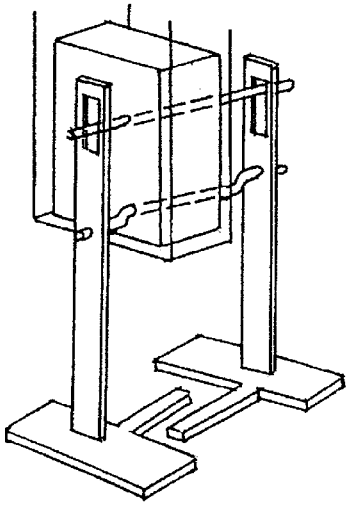
FIG. 1 (PRIOR ART)
FIG. 1 illustrates a prior art arrangement of a crank and rocker walking device.
Figure 2:
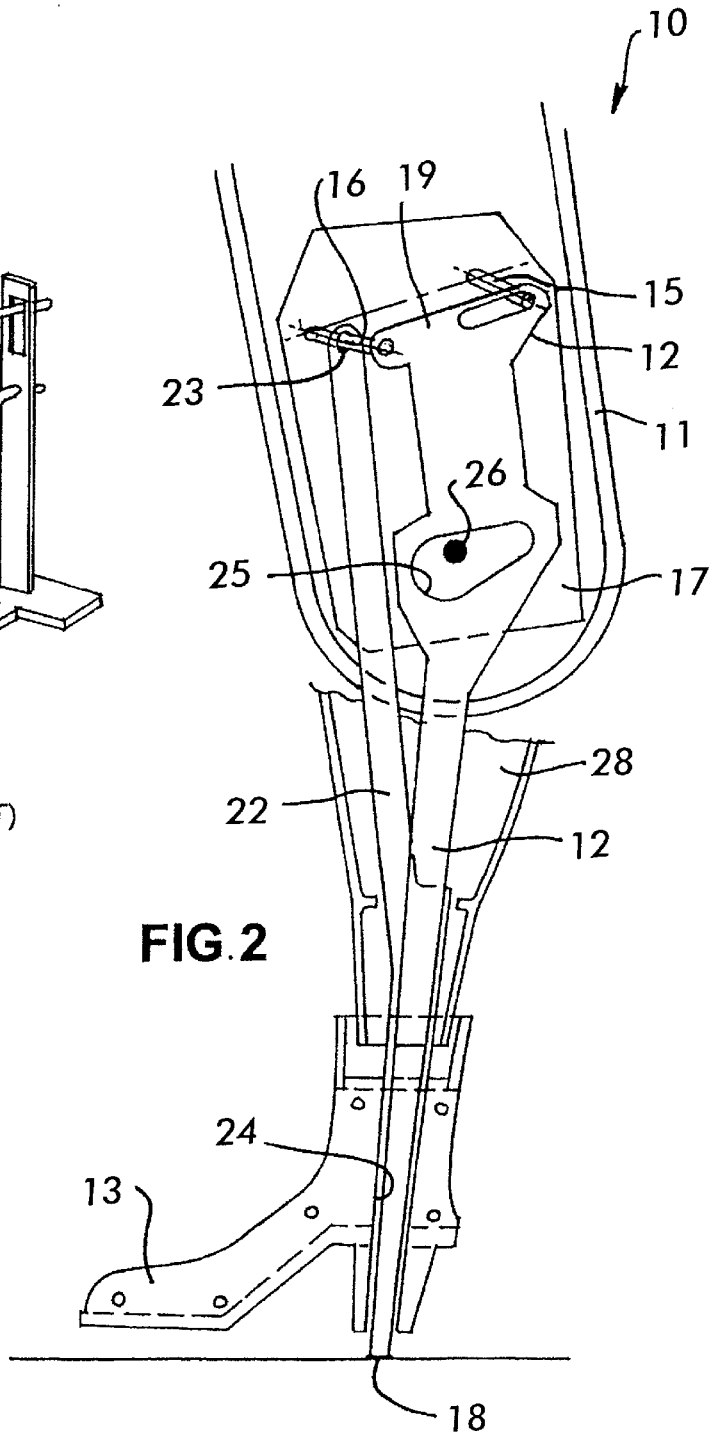
FIG. 2 is a cross sectional view of the leg mechanism of a walking device according to the invention.
Figure 5A:
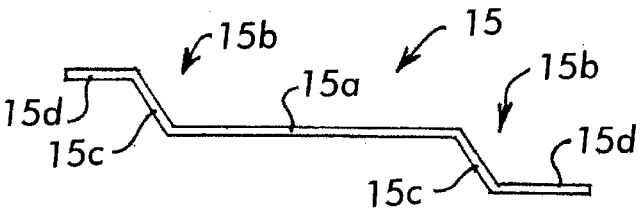
Figure 5B:
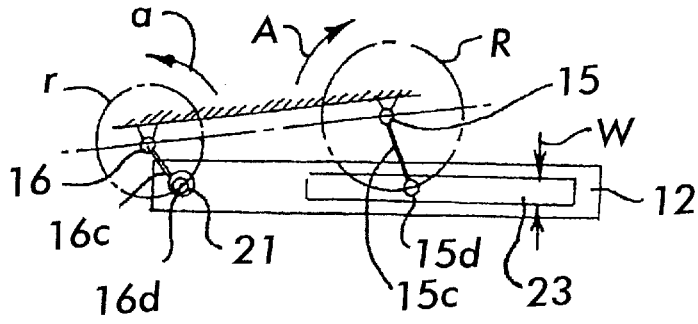
Figure 5C:
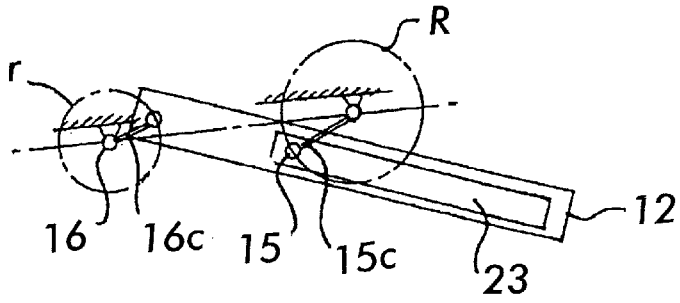
Figure 5D:
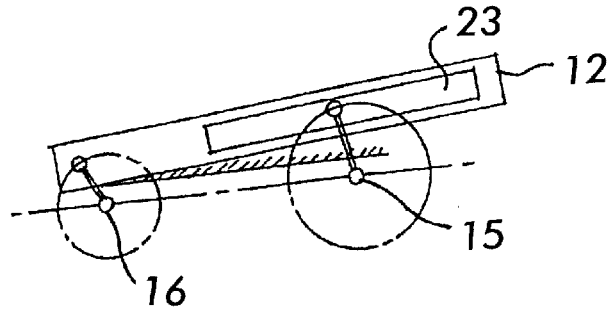
Figure 5E:
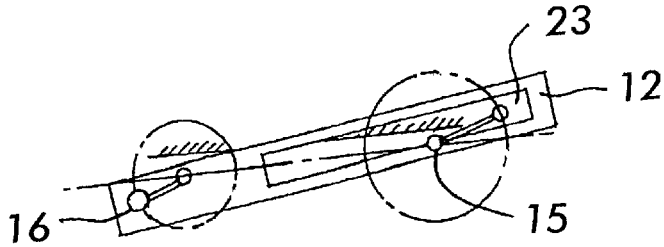

FIG. 5*a* is a view of a crankshaft for employment in the device shown in FIG. 2.

FIGS. 5*b* to 5*e* illustrate the leg movement of the leg mechanism shown in FIG. 2.

Figure 6:
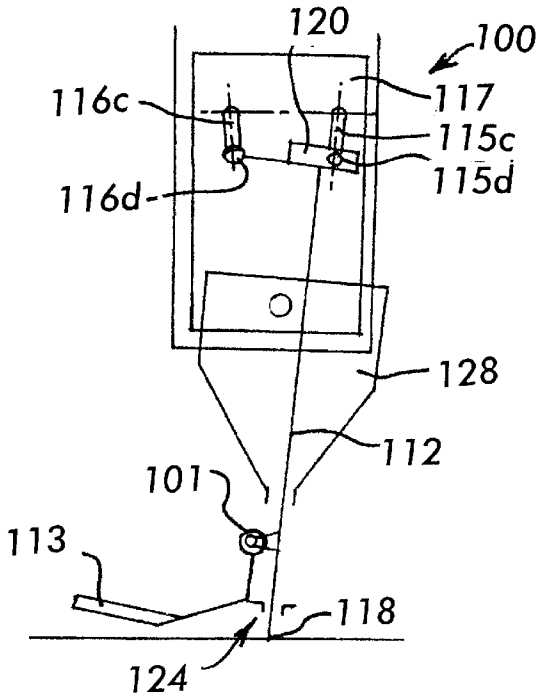

FIG. 6 shows a similar but alternative walking device to the device shown in FIG. 2.

Figure 7:
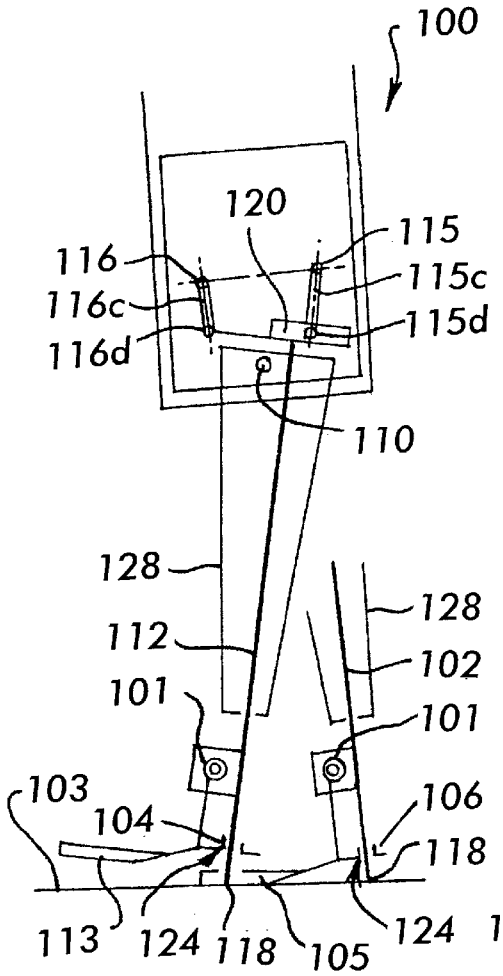
Figure 8:
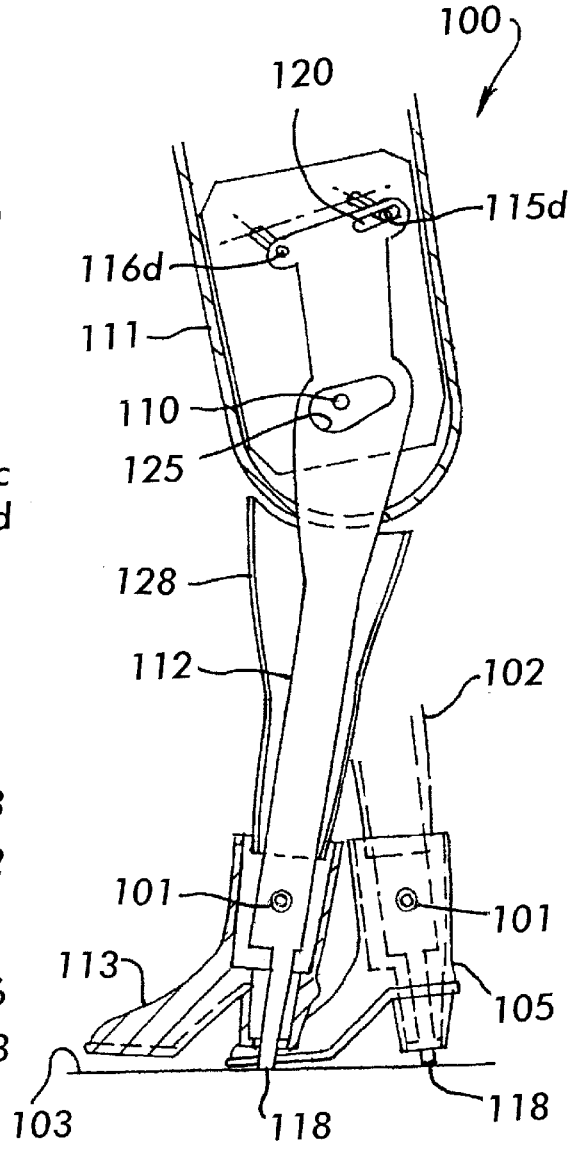

FIGS. 7 and 8 illustrate a second embodiment of the invention.

Figure 9:
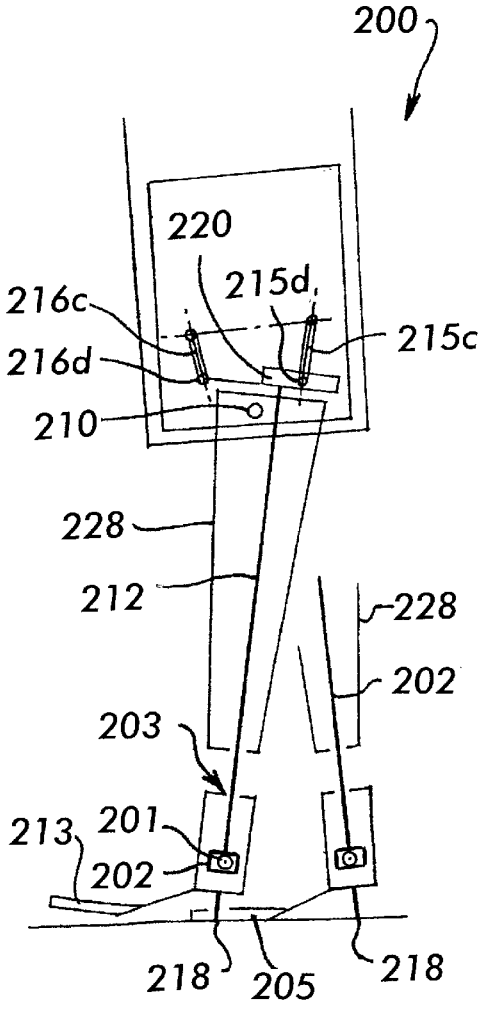
Figure 10:
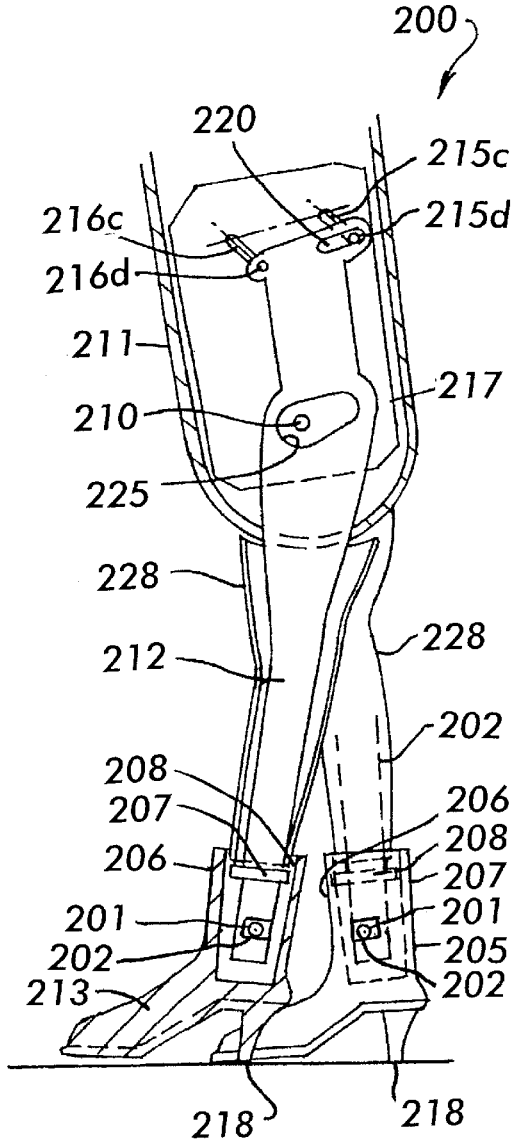

FIGS. 9 and 10 illustrate a third embodiment of the invention.

FIGS. 11 to 15 illustrate a fourth embodiment of the invention.

Figure 16:
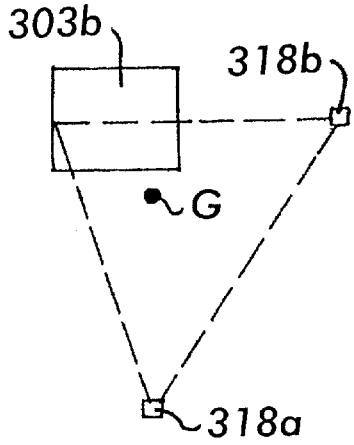
Figure 17:
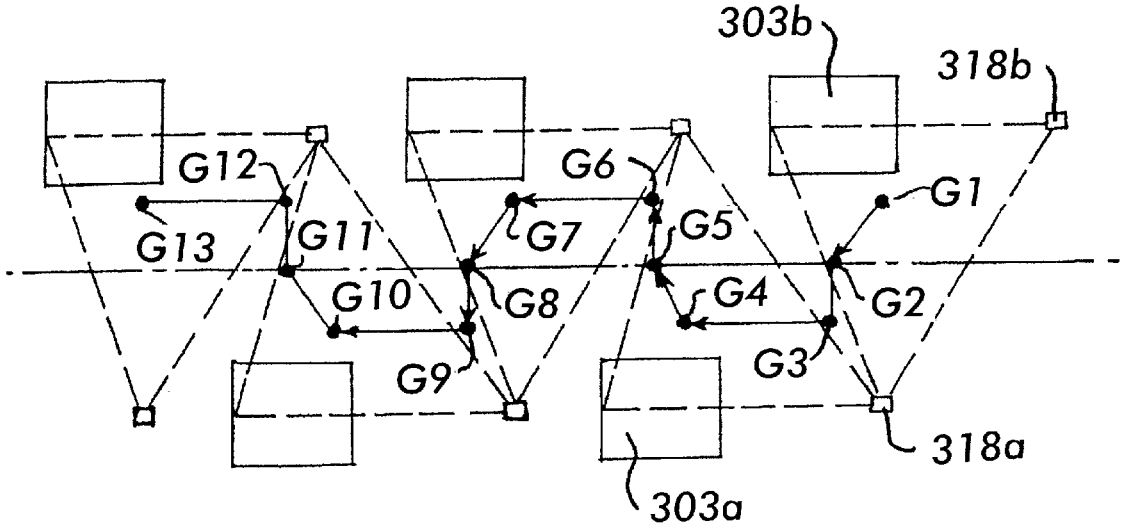

FIGS. 16 and 17 illustrate the position of the centre of gravity of a device according to the invention during walking motion.

Figures 18A, 18B, 18C, 18D:
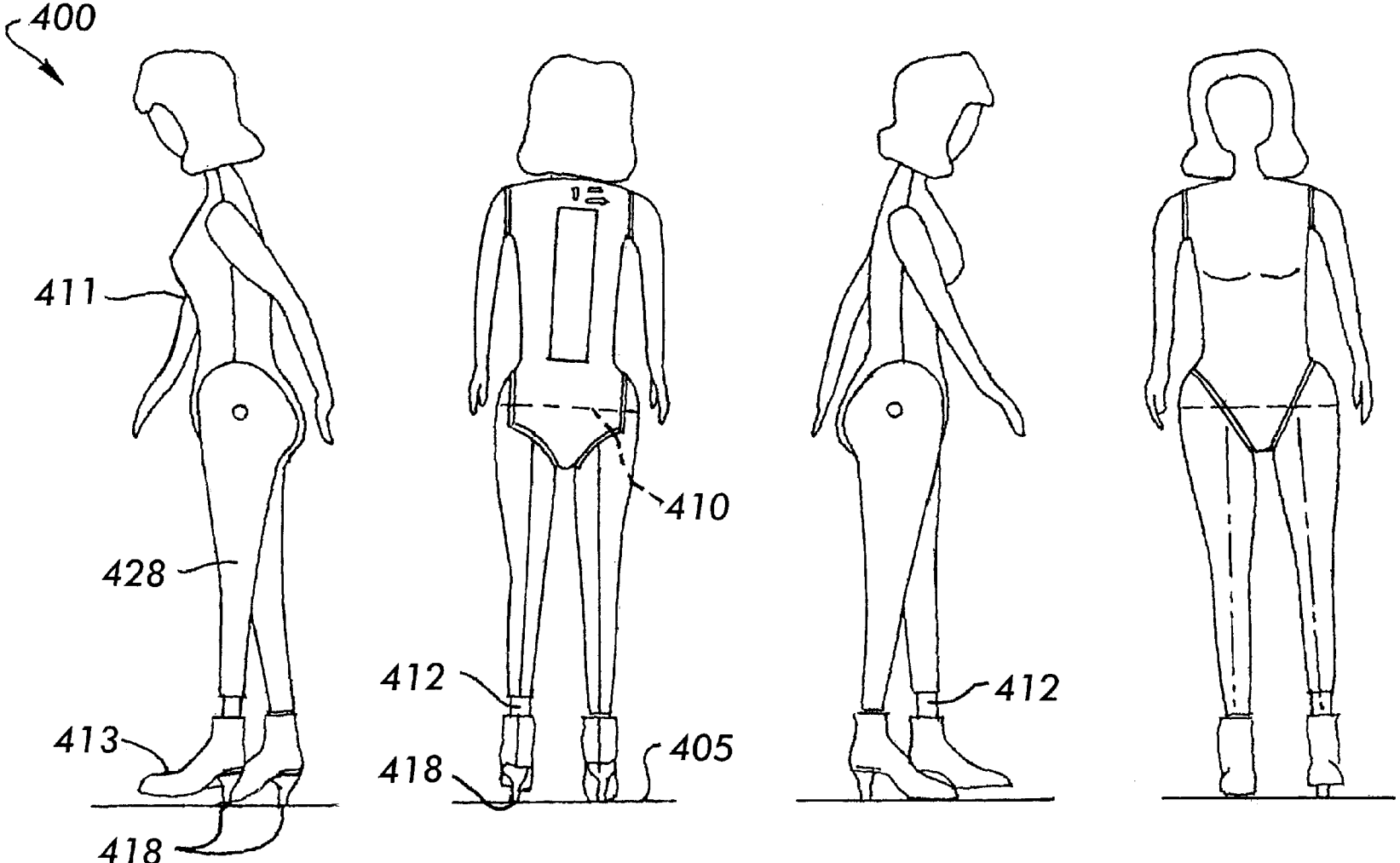

FIGS. 18(*a*) to (*d*) show a female-form of a walking device according to the embodiment illustrated in FIG. 2.

Figure 3:
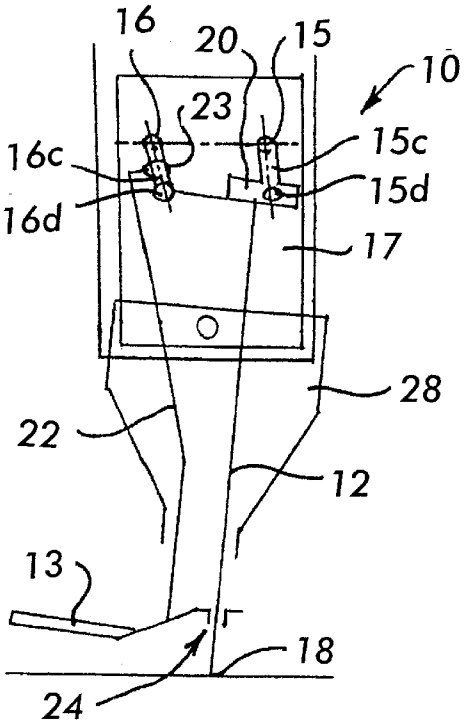
FIG. 3 is a schematic view of the leg mechanism illustrated in FIG. 2.

Referring first to FIG. 2 this shows a cross-sectional view of a walking device 10 according to a first embodiment of the invention while FIG. 3 is a schematic view of the FIG. 2 embodiment. The walking device 10 takes the form of a toy, such as human form, but in FIGS. 2 and 3 only the lower part of such a form is shown. Accordingly the device 10 could have a full torso, arms, neck and head if the device was shown in full. Other forms equally could be possible, such as animals.

The device 10 includes a body portion or torso 11 (shown in part only) and a leg 12 which is connected to one side of the torso 11 and which extends therebelow. FIG. 2 shows a foot 13 disposed toward the distal or free end of the leg 12 and the foot 13 has a shoe-like form which in use, is likely to be applied to such a toy that takes a human-like form. As shown in FIG. 2, the shoe is of a high heel type, such as might be worn by a woman. The construction and the operation of the foot 13 and its relationship with the leg 12 will be discussed in more detail later herein.

Figure 4:
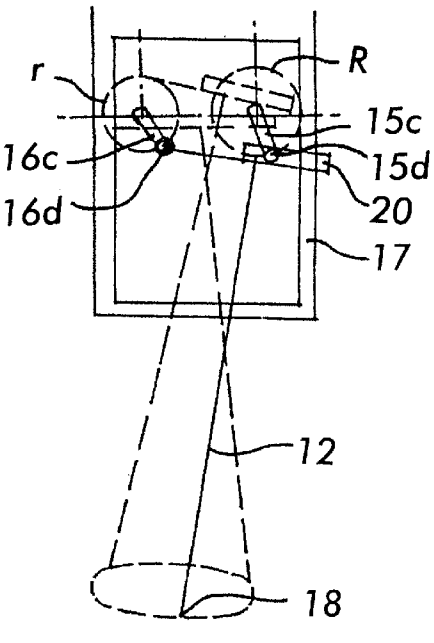
FIG. 4 is a further schematic view of the leg mechanism of FIG. 2.

FIG. 2 and 3 show the device 10 as including a pair of spaced-apart shafts, known as crankshafts 15 and 16, which are connected to the leg 12 at an upper end thereof and which are rotated by an electric motor (not shown) driving through a gearbox 17. Crankshaft rotation is operable to move the leg 12 in an oscillating up and down, forward and backward rotation, as shown in FIG. 4. That movement is arranged to mimic the movement of a human leg and FIG. 4 shown by dash outline, the movement of the heel 18 in a vertically oval path. The heel 18 is formed at the distal or free end of the leg 12 and is independent of or separate from the foot 13. As will become apparent later in this specification however, the foot 13 and the heel 18 cooperate to mimic the movement of a human foot during walking.

One of the crankshafts is shown in FIG. 5*a,* while crankshaft movement is shown schematically in FIGS. 5*b* to 5*e.* FIG. 5*a* shows the crankshaft 15 having a central elongate section 15*a* and at each end thereof, a pair of end portions 15*b* each comprising an angled portion 15*c* and a mounting portion 15*d.* It is apparent from the crankshaft 15 of FIG. 5*a*, that the angled portions 15*c* are angled equally and oppositely from the central portion 15*a* and it is further apparent, that each of the mounting portions 15*d* extends parallel to the central portion 15*a*. The angled portions 15*c* extend from the central portion 15*a* at any suitable angle and could for example extend perpendicular to the central portion 15.

FIGS. 5*b* to 5*e* show the crankshafts 15 and 16 and the connection thereof to the upper end 19 of the leg 12. The upper end 19 includes an elongate slot 20 for receiving the mounting portion 15*d* of the crankshaft 15 and crankshaft rotation is such as to cause the mounting portion 15*d* to traverse lengthwise along the slot 20 between the ends thereof. The width W of the slot 20 is slightly greater than the diameter of the mounting portion 15*d*, so that the mounting portion 15*d* can freely traverse lengthwise of the slot 20, but is otherwise confined against lateral movement transverse thereto.

The upper end 19 further includes a journal opening 21 for close receipt of the mounting portion 16*d* of the crankshaft 16. The journal opening 21 is of a diameter slightly greater than the diameter of the mounting portion 16*d* to accordingly accommodate the mounting portion 16*d* of the crankshaft 16 for rotation only, and without permitting other movement, such as the lengthwise movement available to the mounting portion 15*d* within the slot 20.

As shown in FIGS. 5*b* to 5*e*, the mounting portion 15*d* of the crankshaft 15 has a greater radius of rotation R compared to the radius r of rotation of the mounting portion 16*d* of the crankshaft 16. Also, the respective crankshafts are shown to be rotating in different directions by the arrows A and a. The respective radii of rotation R and r can however be the same and each crankshaft 15, 16 can additionally be rotated in the same direction, provided the rotation is not synchronized, as that would cause the heel 18 to move up and down only and not forward and backward. It is to be appreciated therefore, that crankshaft rotation direction, speed of rotation and radii of rotation may all be altered to achieve the required motion for leg movement. Also, the relative starting positions of the crankshafts 15 and 16 can be adjusted to achieve desired leg movement. See for example FIG. 5*b*, in which the angle to vertical of the portion 16*c* is greater than that of the portion 15*c*. These angles can be adjusted as necessary.

Returning to FIGS. 2 and 3, the device 10 includes a rod 22 which includes an opening 23 for receipt of the crankshaft 16. The rod 22 is required to oscillate like the leg 12, although the oscillation can be lesser than the leg 12. For this, the rod 22 may be mounted to the crankshaft 16 on the angled portion 16*c* rather than to the mounting portion 16*d.* The rod 22 may for example, be mounted on the angled portion 16*c* toward the central portion 16*a* so that the oscillation the rod undergoes is less than if it was mounted on the mounting portion 16*d,* or on the angled portion 16*c* but toward the mounting portion. Advantageously, by shifting the mounting point of the rod 22 along the angled portion, either toward the central portion 16*a* or the mounting portion 16*d,* the amount of rod oscillation can be varied.

The rod 22 is connected to the foot 13, such as integrally or by a suitable connector and is operable to move the foot 13 relative to the leg 12, both up and down and forward and backward. For this, the foot 13 is formed with a slot 24 which accepts the leg 12 and which facilitates relative up and down movement of the foot 13 and the leg 12. The slot 24 can be oversized for that acceptance so as to permit the forward and backward movement of the foot 13 relative to the leg 12 described above. It is to be noted that the rod 22 is not shown in FIG. 4 in which it has been omitted for clarity purposes only.

The slot 24 could alternatively comprise or be formed by a pair or more of abutments, which are spaced apart on either side of the leg 12 and which permit the required foot movement. The slot 24 effectively provides leading and trailing abutments, which guide the foot 13 for up and down movement and which limit foot movement relative to the leg forward and backward.

The leg 12 includes an opening 25 through which a shaft 26 extends. The shaft 26 is fixedly mounted for mounting leg coverings over the leg 12 and the rod 22. One such covering 28 is shown in FIG. 2, but this is shown in part and cross-sectional form only and for clarity is not shown extending to the shaft 26. As will be appreciated from FIG. 2, the covering 28 covers the leg 12 and 10 the rod 22 principally for aesthetic purposes. The covering 28 can take any suitable form as the walking device 10 might require for the different types of form the device might take. The opening 25 has a size sufficient to permit the oscillating movement of the leg 12 about the shaft 26.

The configuration of the leg 12 is very much dependent on the construction of other parts of the walking device 10 and the form the device is required to take or mimic. Thus, the form shown in FIG. 2, is an example form only and the leg could have a different form as necessary to cooperate with the other parts of the device 10.

Operation of the device 10 is as follows. A battery operated electric motor (not shown) is switched on by a suitable on/off switch, typically located on the rear of the device and possibly concealed behind a hinged door or flap. The motor drives through the gearbox 17, to rotate each of the crankshafts 15 and 16. The eccentric mounting portions 15*d*, 16*d,* rotate through the radius R and r shown in FIG. 5*a* to drive the leg 12 in an oscillating manner so that the heel 18 traverses the oval path shown in FIG. 4.

The rod 22 is also driven in an oscillating manner by the angled portion 16*c* on which it is mounted, which is operable to shift the foot 13 along the leg 12 in a reciprocating up and down manner. The foot 13 is also shifted laterally, forward and rearward with respect to the leg 12 to the extent permitted by the abutting edges of the slot 24. In an alternative arrangement, the foot 13 is driven only in an up and down manner, with no forward or rearward shift. Advantageously, the rod 22 is operable to press the foot hard against the surface on which the device is supported, to generate friction between the foot and that surface and to thereby resist slipping of the foot relative to the surface and to promote movement of the device across the surface. Thus, the leg 12 and the foot 13 are driven in a life-like manner as the device 10 "walks" across a supporting surface.

FIG. 6 shows a similar but alternative walking device 100 to the device 10 shown in FIGS. 2 to 5. Where the device 100 includes the same parts as the device 10, those parts have the same reference numeral, plus 100.

The device 100 differs from the device 10 principally by the omission of the rod 22 of the device 10. In the device 100, the foot 113 is pivotably connected to a leg 112 at the pivot connection 101, which is more clearly shown in FIGS. 7 and 8. In these figures, left and right feet 113 and 105 are shown as is the components connected thereto. It can be seen that each foot 113 and 105 includes a slot 124 which facilitates forward and backward movement of the foot 113 like the foot 13 of the leg 12, but without the control provided by the rod 22. Instead, pivoting movement is a function of the position of the leg 112 and of foot contact with the ground or the surface on which the device 100 is supported. FIG. 7 shows the leg 112, as well as the other leg 102 disposed on the other side of the torso 111, to illustrate that in the forward stride of the leg 112, the foot 113 is lifted away from the supporting surface 103 and the forward side 104 of the slot 124 is in resting contact with the leading edge of the leg 112. The leg 102 is in a rearward stride and the foot 105 attached to that resting contact with the trailing edge of the leg 102. As will be readily appreciated, the feet 113 and 105 will pivotally shift between the forward and rearward positions shown in FIG. 7 as the device 100 walks along the surface 103.

It will be appreciated that the heel 118 of FIG. 6 traverses the same or similar oval path as shown in FIG. 4, with the difference between the FIG. 6 and FIG. 2 arrangements residing in the control and type of foot movement. In FIG. 2, movement of the foot 13 is subject to the oscillation of the rod 22, whereas in FIG. 6, the foot 113 will not oscillate up and down in the same manner as the foot 13, but instead will pivot about the point 101, subject to the forward and rearward leg movement.

FIGS. 9 and 10 illustrate a further embodiment of the invention in which parts of similarity with FIGS. 7 and 8 have the same reference numerals plus 100. The device 200 includes a foot 213 which is in pivotal connection with the leg 212 at pivot 201 and the foot 213 includes a slot 202 and a further slot 203. The foot 213 therefore is permitted to rotate about the pivot 201 and to shift forward and backward by movement relative to the leg 212 between the ends of each of the slots 202 and 203. The movement, like the device 100, is dependent on the position or the angular disposition of the leg 212 and on contact with the supporting surface 204.

The slot 203 shown in FIG. 9 is defined by the front and rear walls 206, 207 (FIG. 10) of the feet 213 and 205, and those walls abut against front and rear ends of an abutment 208. The relative movement between the front and rear walls 207, 206 and the front and rear ends of the abutment 208 is governed by the spacing between them. Likewise, the length of the slot 202 governs the amount of foot movement which results from movement of the feet 213 and 205 relative to the pivot 201.

Figure 13:
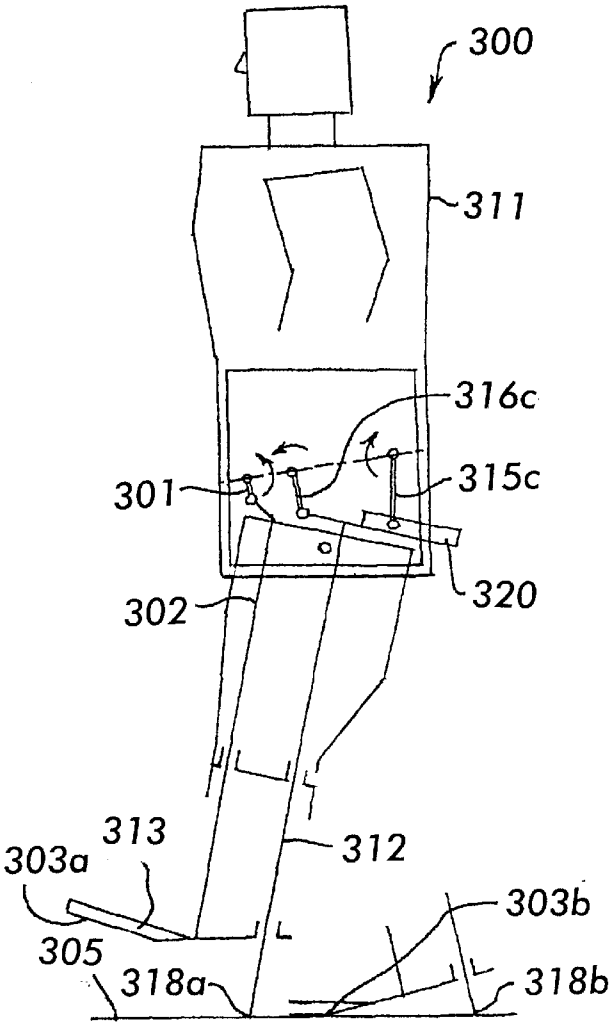
Figure 11:
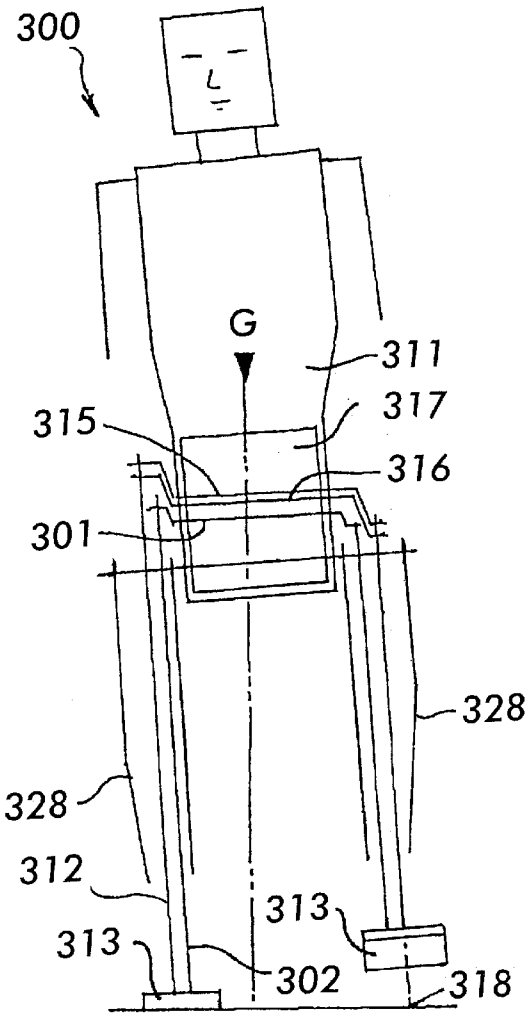
Figure 12:
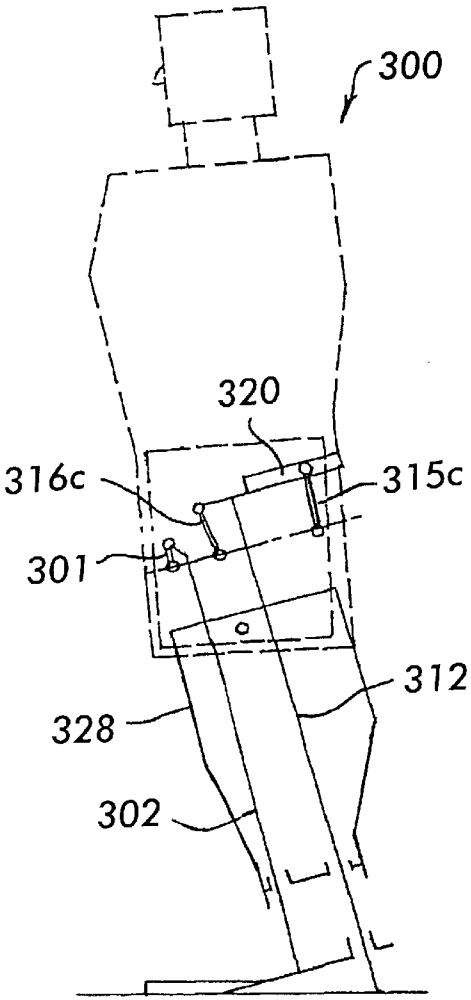

FIGS. 11 to 13 show a further embodiment of the invention in a device 300 in which like parts from FIGS. 9 and 10 have the same reference numeral, 301 drives a rod 302 and the arrangement is such that the heels 318 of each of the left and right feet maintain permanent contact with the supporting surface 305 during walking movement. This is illustrated particularly with respect to FIG. 13 in which the forward heel 318*a* and the rearward heel 318*b* are both in contact with the ground at the same time despite the legs being at the opposite ends of forward and rearward strides. In this arrangement, the sole 303*b* of the backward foot 313 is pressed hard against the ground by the rod 302, so that friction against the supporting surface 305 resists slipping of the sole, to ensure that the device 300 moves or walks forward.

The arrangement of FIGS. 11 to 13 provides positive foot control similar to that of FIG. 2 and different to the "passive" pivoting arrangement of FIGS. 7 and 9. Thus, the feet of the device 300 are raised and lowered on the crankshaft 301 which takes the same general configuration of the crankshafts 15, 16 of FIG. 5*a*. The crankshaft 301 therefore has an angled portion and an eccentric mounting portion on which the rod 302 is mounted and driven to oscillate. The radius of rotation of the mounting portion can be of any suitable amount relative to the other functional components of the device 300.

The arrangement of the walking device 300 is particularly suitable for a device which is large and heavy and which requires strong foot support. Such a device would also have sufficient room within the torso to accommodate the third crankshaft 301. For a smaller or medium sized toy, the FIGS. 2 and 3 embodiment is more suitable, as the smaller torso of that embodiment has insufficient space to accommodate the third crankshaft. The FIGS. 6 and 9 embodiments are suitable for a small sized device. In these embodiments the size and weight of the device does not require support extending from the feet to the torso which is required for the FIGS. 2, 3 and 13 embodiments.

Figure 15:
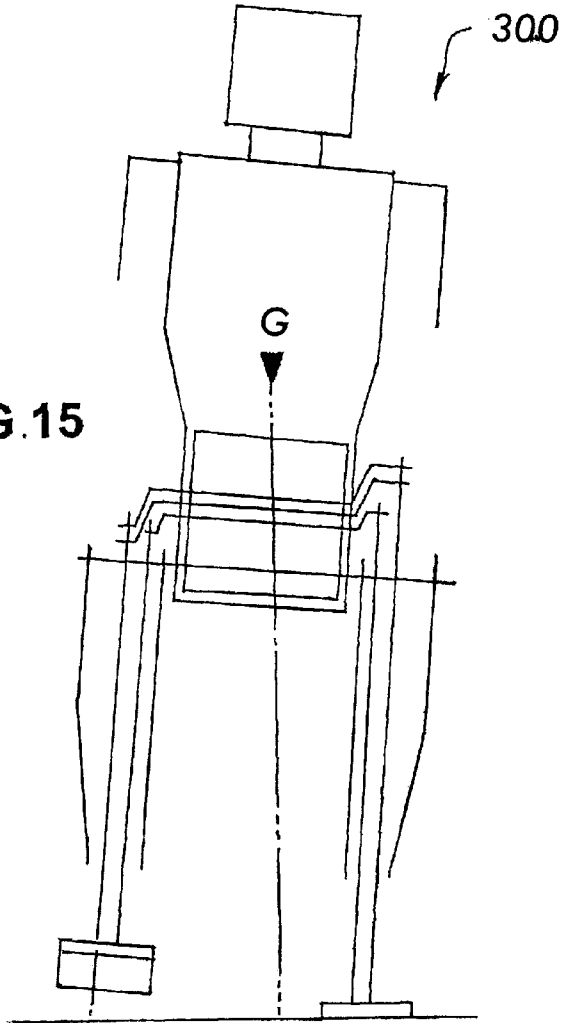
Figure 14:
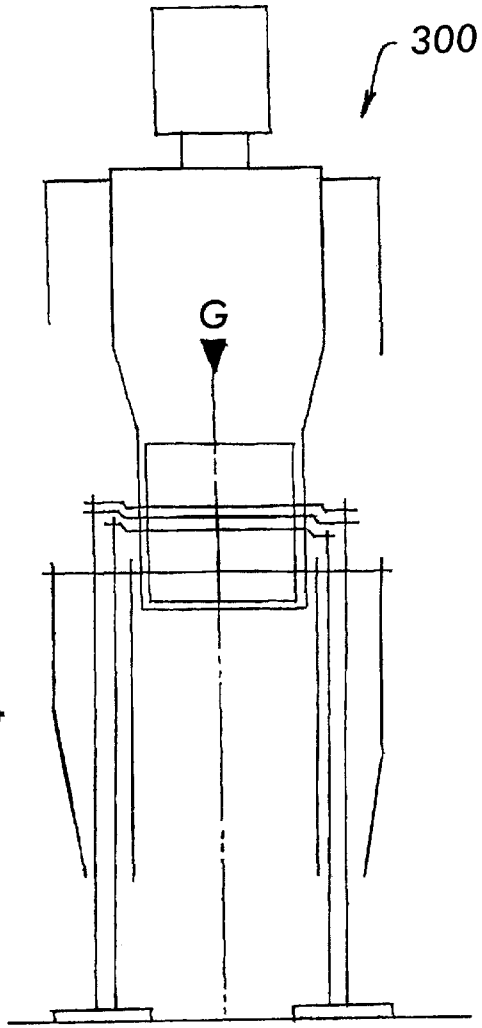

FIGS. 11, 14 and 15 represent a sequence of walking motion of the device 300 and each figure also shows movement of the centre of gravity G of that device. The movement sequence shows that the device 300 walks, while FIG. 16 and 17 shows that the centre of gravity G is maintained within an imaginary triangle defined by the points of heel contact with the supporting surface and the point of sole contact. As explained above, each of the heels 318*a* and 318*b* remains in contact with the ground at all times, while one of the soles 303*a* or 303*b* is also in contact with the ground. By confining the centre of gravity G to within the triangle shown in FIG. 16, the device 300 is prevented from toppling. This is despite the successive leaning of the device from side-to-side as shown in FIGS. 11, 14 and 15.

FIG. 17 illustrates the movement of the centre of gravity G as the device 300 walks forward through G1 to G13. This further illustrates the confinement of the centre of gravity G to within the triangle discussed above as the device walks forward. In this figure, the sole 303*a* is shown on one side of the centre line C of movement, while the other sole 303*b* is disposed on the other side of the centre line C.

FIG. 18 shows a more life-like device according to the invention, compared to the previous embodiments of the earlier figures. The FIG. 18 device 400 takes a human and female form, including high-heeled shoes 413. The reference numerals used in FIG. 18 use the same numbers as FIG. 2, plus 400. As illustrated, much of the mechanism of the earlier embodiments is concealed within the torso 411 and the leg coverings 428. However, the leg 412 can be seen in the gap between the leg coverings 428 and the foot 413. The FIG. 18 sequence also shows how the device 400 leans from side-to-side as the device walks across the supporting surface 405.

A device according to the invention provides life-like leg movement as the device walks, principally by the provision of two crankshafts. The devices is distinguished from the prior art in this respect and the device of the invention can provide greater likeness of human leg movement during walking.

The invention described herein is susceptible to variations, modifications and/or additions other than those specifically described and it is to be understood that the invention includes all such variations, modifications and/or additions which fall within the spirit the scope of the above description.

What is claimed is:

1. A walking device comprising:

i. a body portion, defining a front, a rear and sides extending therebetween;

ii. a pair of legs, one leg being disposed on each side of said body portion and connected at an upper end to said body portion and defining a heel at the opposite and lower end for engagement with a supporting surface;

iii. a foot disposed at said lower end of said leg;

iv. a pair of spaced-apart shafts extending through the sides of said body portion for said connection of said legs to said body portion, wherein each shaft includes an eccentric end portion at each end thereof in connection respectively with said legs, each said end portion being received within an opening formed in said leg, a first of the openings being a journal opening which confines said end portion to rotation relative to said leg, and a second of the openings being formed as a slot and permitting said end portion rotational and lengthwise movement within said slot relative to said leg, whereby rotation of each said shaft causes said legs to move in a walking motion, in generally opposite directions.

2. A walking device according to claim 1, wherein said shafts are rotated in opposite directions of rotation.

3. A walking device according to claim 1, wherein said shafts are rotated in the same direction of rotation.

4. A manner device according to claim 1, wherein said legs move in a manner so that each said heel transverses a generally vertical oval path relative to said body portion.

5. A walking device according to claim 1, wherein said eccentric end portions associated with each said leg have a different radius of rotation.

6. A walking device according to claim 1, wherein said openings are spaced generally horizontally when said device is standing upright.

7. A walking device according to claim 1, said foot being movable relative to said leg both lengthwise of said leg up and down and control means controlling foot movement in said lengthwise directions.

8. A walking device according to claim 7, said control means comprising a member extending in connection with a said end portion of one of said shafts and rotation of said shaft causing said lengthwise movement of said foot by corresponding movement of said member.

9. A walking device according to claim 8, said member being an elongate rod.

10. A walking device according to claim 7, said foot additionally being movable by said control means forward and rearward relative to said leg in the direction of leg movement.

11. A walking device according to claim 10, said foot including forward and rearward abutments for abutting said leg in maximum forward and rearward positions of displacement.

12. A walking device according to claim 11, said foot including a through slot for receiving said leg, so that said leg extends through said foot for said heel to engage said supporting surface, said slot defining said forward and rearward abutments for abutting opposite sides of said leg in a maximum forward and rearward displacement.

13. A walking device according to claim 10, said control means comprising an elongate member extending in connection with a said end portion of one of said shafts and rotation of said shaft causing said forward and rearward movement of said foot by corresponding movement of said member.

14. A walking device according to claim 13, said member being an elongate rod.

15. A walking device according to claim 7, said control means comprising a pivoted connection associated with said leg and said foot being connected pivotably to said pivoted connection, said foot further including forward and rearward abutments for abutting said leg in maximum forward and rearward positions of displacement, said foot being freely pivotable between said positions of maximum forward and rearward displacement as said leg moves said heel through said generally vertical oval path.

16. A walking device according to claim 7, said control means comprising an elongate slot formed in one of said foot or said leg and extending in the direction of forward leg movement, a pin projecting from the other of said foot or said leg and being received in said slot, said foot further including forward and rearward abutments for abutting said leg in maximum forward and rearward positions of displacement, said foot being able to pivot on said pin between said forward and rearward abutments and to shift relative to said pin between opposite ends of said slot.

17. A walking device according to claim 7, said control means comprising a third shaft having eccentric end positions at each end thereof, a member connected to each said end portion at one end and in connection with said foot at the other and opposite end, rotation of said third shaft being such as to shift said foot lengthwise of said leg and forward and rearward with respect to said leg.

18. A walking device according to claim 17, said foot includes forward and rearward abutments for abutting said leg in maximum forward and rearward positions of displacement.

19. A walking device according to claim 1, wherein leg movement by rotation of said shafts is such as to maintain said heel of each leg and the sole of one of said feet in contact which said supporting surface during leg movement.

20. A walking device according to claim 19, wherein said device leans laterally with respect to the direction of walking movement of said device from side-to-side, the device being constructed so that the centre of gravity thereof is maintained to within a triangle defined between the points of contact of said heels and the respective sole in contact with said supporting surface at any time during walking movement.

* * * * *